US007261154B2

(12) United States Patent
Hall et al.

(10) Patent No.: US 7,261,154 B2
(45) Date of Patent: Aug. 28, 2007

(54) CONFORMABLE APPARATUS IN A DRILL STRING

(75) Inventors: David R. Hall, Provo, UT (US); H. Tracy Hall, Jr., Provo, UT (US); David S. Pixton, Lehi, UT (US); Joe Fox, Spanish Fork, UT (US)

(73) Assignee: IntelliServ, Inc., Provo, UT (US)

( * ) Notice: Subject to any disclaimer, the term of this patent is extended or adjusted under 35 U.S.C. 154(b) by 367 days.

(21) Appl. No.: 10/710,936

(22) Filed: Aug. 13, 2004

(65) Prior Publication Data

US 2005/0039912 A1 Feb. 24, 2005

Related U.S. Application Data

(63) Continuation-in-part of application No. 10/212,187, filed on Aug. 5, 2002, now Pat. No. 6,799,632.

(51) Int. Cl.
*E21B 17/00* (2006.01)

(52) U.S. Cl. ..... 166/242.2; 166/207

(58) Field of Classification Search ..... None
See application file for complete search history.

(56) References Cited

U.S. PATENT DOCUMENTS

| | | | |
|---|---|---|---|
| 749,633 | A | 1/1904 | Seeley |
| 2,178,931 | A | 11/1939 | Crites et al. |
| 2,301,783 | A | 11/1942 | Lee |
| 2,354,887 | A | 8/1944 | Silverman et al. |
| 2,379,800 | A | 7/1945 | Hare |
| 2,414,719 | A | 1/1947 | Cloud |
| 2,633,414 | A | 3/1953 | Boivinet |
| 2,659,773 | A | 11/1953 | Barney |
| 2,662,123 | A | 12/1953 | Koenig, Jr. |

(Continued)

FOREIGN PATENT DOCUMENTS

| | | | |
|---|---|---|---|
| EP | 0399987 | A1 | 11/1990 |

(Continued)

OTHER PUBLICATIONS

PCT/US03/16475, Published Dec. 4, 2003, Applicant Baker Hughes; International Search Report: "Documents Considered to Be Relevant".

*Primary Examiner*—Zakiya W. Bates
(74) *Attorney, Agent, or Firm*—Tyson J. Wilde; Jeffrey E. Daly

(57) ABSTRACT

An apparatus in a drill string comprises an internally upset drill pipe. The drill pipe comprises a first end, a second end, and an elongate tube intermediate the first and second ends. The elongate tube and the ends comprising a continuous an inside surface with a plurality of diameters. A conformable metal tube is disposed within the drill pipe intermediate the ends thereof and terminating adjacent to the ends of the drill pipe. The conformable metal tube substantially conforms to the continuous inside surface of the metal tube. The metal tube may comprise a non-uniform section which is expanded to conform to the inside surface of the drill pipe. The non-uniform section may comprise protrusions selected from the group consisting of convolutions, corrugations, flutes, and dimples. The non-uniform section extends generally longitudinally along the length of the tube. The metal tube may be adapted to stretch as the drill pipes stretch.

20 Claims, 11 Drawing Sheets

U.S. PATENT DOCUMENTS 2,974,303 A 3/1961 Dixon
2,982,360 A 5/1961 Morton et al.
3,079,549 A 2/1963 Martin
3,090,031 A 5/1963 Lord
3,186,222 A 6/1965 Martin
3,194,886 A 7/1965 Mason
3,209,323 A 9/1965 Grossman, Jr.
3,227,973 A 1/1966 Gray
3,518,608 A 6/1970 Papadopoulos
3,696,332 A 10/1972 Dickson, Jr. et al.
3,793,632 A 2/1974 Still
3,807,502 A 4/1974 Heilhecker et al.
3,879,097 A 4/1975 Oertle
3,930,220 A 12/1975 Shawhan
3,957,118 A 5/1976 Barry et al.
3,989,330 A 11/1976 Cullen et al.
4,012,092 A 3/1977 Godbey
4,087,781 A 5/1978 Grossi et al.
4,095,865 A 6/1978 Denison et al.
4,121,193 A 10/1978 Denison
4,126,848 A 11/1978 Denison
4,215,426 A 7/1980 Klatt
4,220,381 A 9/1980 van der Graaf
4,348,672 A 9/1982 Givler
4,445,734 A 5/1984 Cunningham
4,537,457 A 8/1985 Davis, Jr. et al.
4,578,675 A 3/1986 MacLeod
4,605,268 A 8/1986 Meador
4,660,910 A 4/1987 Sharp et al.
4,683,944 A 8/1987 Curlett
4,698,631 A 10/1987 Kelly, Jr. et al.
4,722,402 A 2/1988 Weldon
4,785,247 A 11/1988 Meador et al.
4,788,544 A 11/1988 Howard
4,806,928 A 2/1989 Veneruso
4,865,127 A * 9/1989 Koster ..... 166/277
4,884,071 A 11/1989 Howard
4,901,069 A 2/1990 Veneruso
4,914,433 A 4/1990 Galle
4,924,949 A 5/1990 Curlett
5,008,664 A 4/1991 More et al.
5,052,941 A 10/1991 Hernandez-Marti et al.
5,148,408 A 9/1992 Matthews
5,248,857 A 9/1993 Ollivier
5,278,550 A 1/1994 Rhein-Knudsen et al.
5,302,138 A 4/1994 Shields
5,311,661 A 5/1994 Zifferer
5,332,049 A 7/1994 Tew
5,334,801 A 8/1994 Mohn
5,371,496 A 12/1994 Tanamachi
5,390,742 A * 2/1995 Dines et al. ..... 166/297
5,454,605 A 10/1995 Mott
5,455,573 A 10/1995 Delatorre
5,505,502 A 4/1996 Smith et al.
5,517,843 A 5/1996 Winship
5,521,592 A 5/1996 Veneruso
5,568,448 A 10/1996 Tanigushi et al.
5,650,983 A 7/1997 Kondo et al.
5,660,211 A * 8/1997 Hiraide et al. ..... 138/143
5,691,712 A 11/1997 Meek et al.
5,743,301 A 4/1998 Winship
RE35,790 E 5/1998 Pustanyk et al.
5,810,401 A 9/1998 Mosing et al.
5,833,490 A 11/1998 Bouldin
5,853,199 A 12/1998 Wilson
5,856,710 A 1/1999 Baughman et al.
5,898,408 A 4/1999 Du
5,908,212 A 6/1999 Smith et al.
5,924,499 A 7/1999 Birchak et al.
5,942,990 A 8/1999 Smith et al.
5,955,966 A 9/1999 Jeffryes et al.
5,959,547 A 9/1999 Tubel et al.
5,971,072 A 10/1999 Huber et al.
6,030,004 A 2/2000 Schock et al.
6,041,872 A 3/2000 Holcomb
6,045,165 A 4/2000 Sugino et al.
6,046,685 A 4/2000 Tubel
6,057,784 A 5/2000 Schaaf et al.
6,104,707 A 8/2000 Abraham
6,108,268 A 8/2000 Moss
6,123,561 A 9/2000 Turner et al.
6,141,763 A 10/2000 Smith et al.
6,173,334 B1 1/2001 Matsuzaki et al.
6,177,882 B1 1/2001 Ringgenberg et al.
6,188,223 B1 2/2001 van Steenwyk et al.
6,196,335 B1 3/2001 Rodney
6,223,826 B1 5/2001 Chau et al.
6,354,373 B1 * 3/2002 Vercaemer et al. ..... 166/277
6,367,565 B1 4/2002 Hall
6,392,317 B1 5/2002 Hall et al.
2002/0135179 A1 9/2002 Boyle et al.
2002/0193004 A1 12/2002 Boyle et al.
2003/0070842 A1 4/2003 Bailey et al.
2003/0178197 A1 * 9/2003 Smith et al. ..... 166/313
2004/0039466 A1 2/2004 Lilly et al.

FOREIGN PATENT DOCUMENTS

WO WO8801096 2/1988
WO W09014497 11/1990

* cited by examiner

CONFORMABLE APPARATUS IN A DRILL STRING

CROSS REFERENCE TO RELATED APPLICATIONS

The present application is a continuation-in-part of U.S. patent application Ser. No. 10/212,187 filed on Aug. 5, 2002, now U.S. Pat. No. 6,799,632 which is herein incorporated by reference.

FEDERAL RESEARCH STATEMENT

This invention was made with government support under Contract No. DE-FC26-01NT41229 awarded by the U.S. Department of Energy. The government has certain rights in the invention.

BACKGROUND OF INVENTION

This invention relates to an apparatus in a drill string. Specifically, this invention is a metal tube having its original diameter sufficiently reduced by the formation of non-uniform protrusions on its surface so that it may be inserted into the bore of an internally upset drill pipe. The metal tube is disposed within the drill pipe, and then expanded to conform to the inside surface of the pipe. The protrusions allow the tube to be expanded to at least its original diameter without rupturing the wall of the tube.

The idea of putting a metal tube as a liner into a drill pipe for the purpose of improving the corrosion resistance of the drill pipe and for providing a passageway for electrical conductors and fluid flow is not new. Those who are skilled in the art are directed to the following disclosures as references for installing a metal tube in a drill pipe.

U.S. Pat. No. 2,379,800, to Hare, incorporated herein by this reference, disclosed the use of a protective shield for conductors and coils running along the length of the drill pipe. The shield served to protect the conductors from abrasion that would be caused by the drilling fluid and other materials passing through the bore of the drill pipe.

U.S. Pat. No. 2,633,414, to Boivinet, incorporated herein by this reference, disclosed a liner for an autoclave having folds that allowed the liner to be installed into the autoclave. Once the liner was installed, it was expanded against the inside wall of the autoclave using hydraulic pressure.

U.S. Pat. No. 5,311,661, to Zifferer, incorporated herein by this reference, teaches a method for forming corrugations in the wall of a copper tube. The corrugations are formed by drawing or pushing the tube through a system of dies to reduce the diameter of the end portions and form the corrugations in center portion. Although the disclosure does not anticipate the use of a corrugated liner in drill pipe or other downhole component, the method of forming the corrugations is readily adaptable for that purpose.

U.S. Pat. No. 5,517,843, to Winship, incorporated herein by this reference, discloses a method of making an upset end on metal pipe. The method of the reference teaches that as the end of the metal tube is forged, i.e. upset, the wall thickness of the end of the pipe increases and inside diameter of the pipe is reduced. The upsetting process, therefore, results in an overall changing topography along the inside wall of the drill pipe.

U.S. Pat. Nos. 4,865,127; and 6,354,373 and Publication Number 2003/0178197 disclose lining a production well or a well bore. U.S. Pat. No. 5,390,742 to Dines, et al. discloses a patch for a longitudinally spaced series of tubular nipple structures installed in a well flow conductor operatively extending through a subterranean well bore. The walls of drill pipe and of production nipples require different characteristics. A drill pipe must be sufficiently strong to withstand the rotary motion and drilling strains experienced by a drill string, while the nipple comprises thinned walls such that a perforating gun may more easily rupture the wall.

U.S. application Ser. No. 10/707,232 filed by the applicants of the present invention on Nov. 29, 2003 discloses a liner insertable into the central bore of a down-hole tool which includes a resilient material rolled into a substantially cylindrical shape. The outside diameter of the liner is variable to allow the liner to be inserted into a narrowed bore of the downhole tool near the box end or pin end. Once past the narrowed bore, the outside diameter of the liner self-expands within the central bore of the downhole tool.

SUMMARY OF INVENTION

An apparatus in a drill string comprises an internally upset drill pipe. The drill pipe comprises a first end, a second end, and an elongate tube intermediate the first and second ends. The elongate tube and the ends comprising a continuous an inside surface with a plurality of diameters. A conformable metal tube is disposed within the drill pipe intermediate the ends thereof and terminating adjacent to the ends of the drill pipe. The conformable metal tube substantially conforms to the continuous inside surface of the metal tube.

The metal tube may be made of a material selected from the group consisting of steel, stainless steel, titanium, aluminum, copper, nickel, chrome, molybdenum, compounds, mixtures, and alloys thereof. The apparatus may comprise a metal tube which is more corrosion resistant than the drill pipe. The corrosion resistance may extend the utility of the drill pipe. Fluids traveling within the bore of the drill pipes may create a solution allowing electrons to pass between the metal tube and drill pipe. An electrically insulating material between the metal tube and the drill pipe may resist this galvanic corrosion between the metal tube and the drill pipe; thereby, preserving the apparatus.

The metal tube may comprise a non-uniform section which is expanded to conform to the inside surface of the drill pipe. The non-uniform section may comprise protrusions selected from the group consisting of convolutions, corrugations, flutes, and dimples. The non-uniform section extends generally longitudinally along the length of the metal tube. The metal tube may be adapted to stretch as the drill pipes stretch. The metal tube may have a regular end portion that is free of the non-uniform section. The non-uniform section of the metal tube may extend spirally along the surface of the metal tube. The non-uniform section may also be intermediate the end portions of the tube.

The non-uniform section of the metal tube may be formed by using hydraulic pressure, by roll forming, or by stamping. More than one die may be used to form the non-uniform section of the metal tube. A rough outside surface of the metal tube may help in bonding the metal tube to the inside surface of the drill pipe. The metal tube may be expanded inside the drill pipe by using hydraulic pressure or by drawing a mandrel over the uniform section. The metal tube may be placed in the drill pipe before the drill pipe is added to the drill string. Preferably, the non-uniform section of the metal tube is expanded and compressed against the inside surface of the drill pipe.

The inside surface may comprise a transition region comprising a plurality of diameters and forming a convex region and a concave region in the inside surface of the drill pipe. The concave region may comprises a resilient ring, which may lessen the stress felt by the metal tube as it is expanded to conform to the inside surface of the drill pipe and prevent the metal tube from tearing.

DETAILED DESCRIPTION

Figure 1:
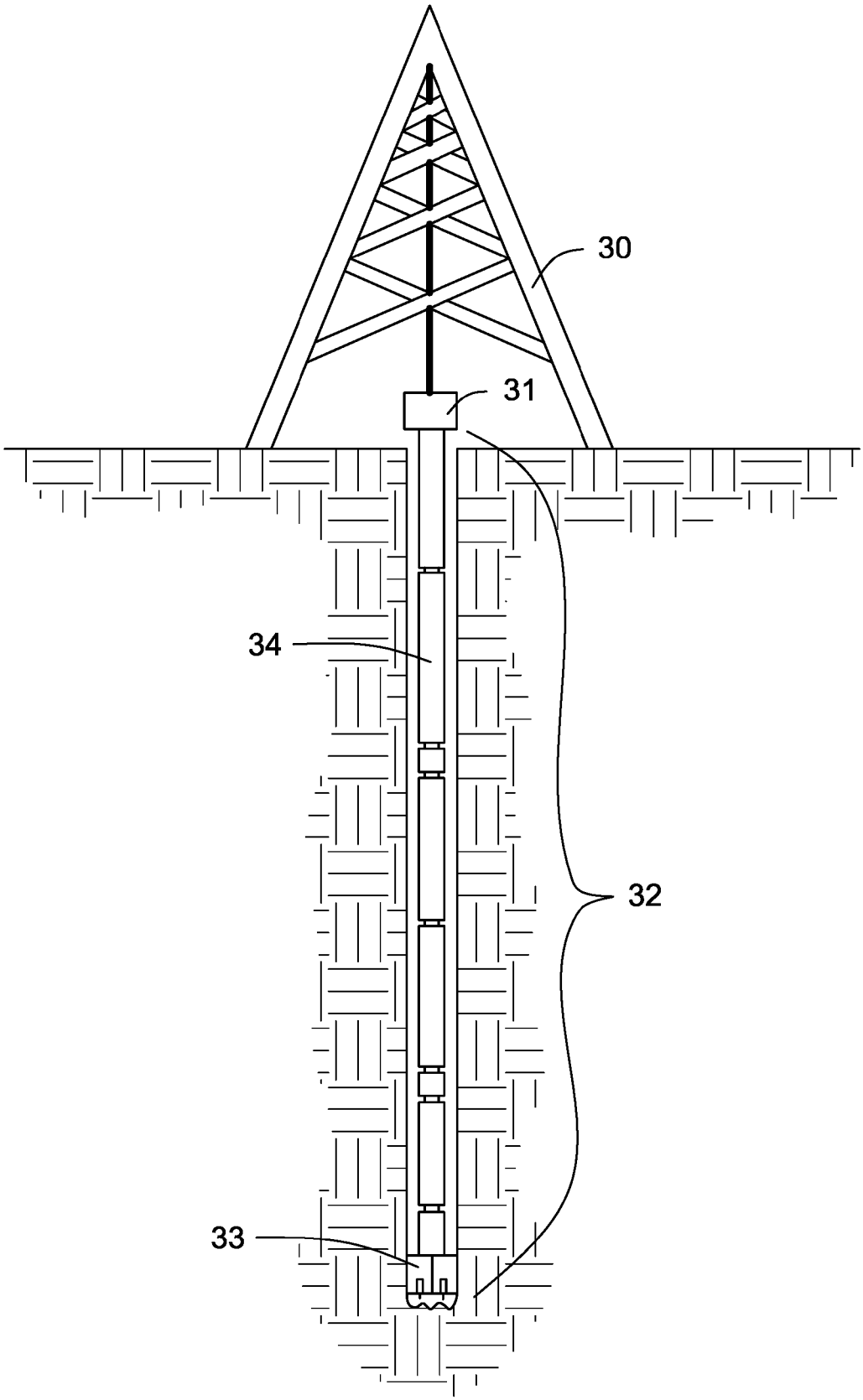
FIG. 1 is a perspective view of a drill string suspended by a derrick.

FIG. 1 shows an embodiment of a drill string 32 suspended by a derrick 30. The drill string 32 comprises a multiplicity of drill pipe 34 intermediate a bottom hole assembly 33 and a swivel 31. The bottom hole assembly 33 may comprise drill bits, hammers, sensors, and other tools that may aid in drilling. The swivel 31 may provide stability to the drill string 31. In one aspect of the invention the drill string 32 is capable of transmitting electrical signals from bottom hole assembly 33 or other points along the drill string 32 to the surface. Such a system is disclosed in U.S. Pat. No. 6,670,880 to Hall, et al, which is herein incorporated by reference.

Figure 2:
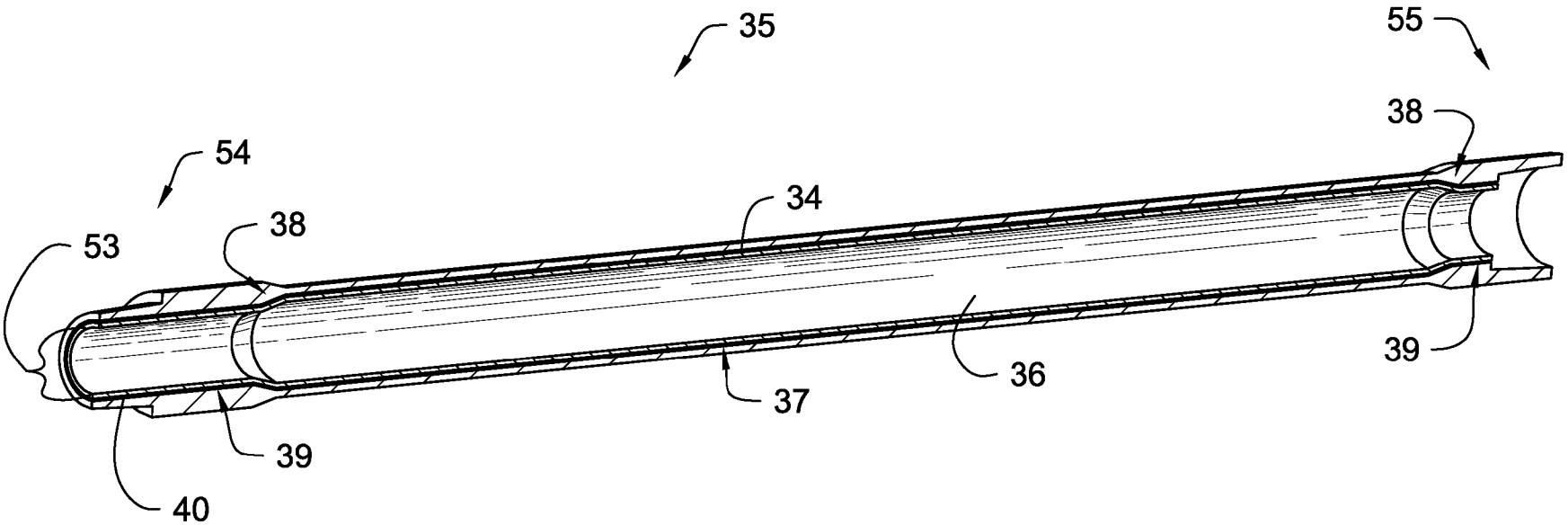
FIG. 2 is a cross sectional view of the present invention.

FIG. 2 is a cross sectional view of the apparatus 35 comprising an internally upset drill pipe 34 with a conformable metal tube 36 disposed within a central bore 53 of the drill pipe 34. Transition regions 38 comprising a plurality of diameters lay intermediate a first diameter 39 and a second diameter 37 in both the pin end 54 and the box end 55 of the drill pipe 34. The pin end 54 may be considered the first end and the box end 55 may be considered the second end. The second diameter is generally consistent along the elongate tube portion if the drill pipe 34. For clarity, the metal tube 36 is shown not fully expanded against the inside surface 40 of the drill pipe 34. However, as the metal tube 36 is fully expanded against the inside surface 40 of the drill pipe 34, the transition regions 38 serve to lock the metal tube 36 in place so that the metal tube 36 is not only held in position by being in compression against the inside surface 40, but is also locked in position by the transition region 38. A metal tube 36 thus installed into a drill pipe has many advantages, among them are the improvement of the hydraulic properties of the bore 53 of the pipe 34, as well as corrosion and wear resistance.

Figure 3:
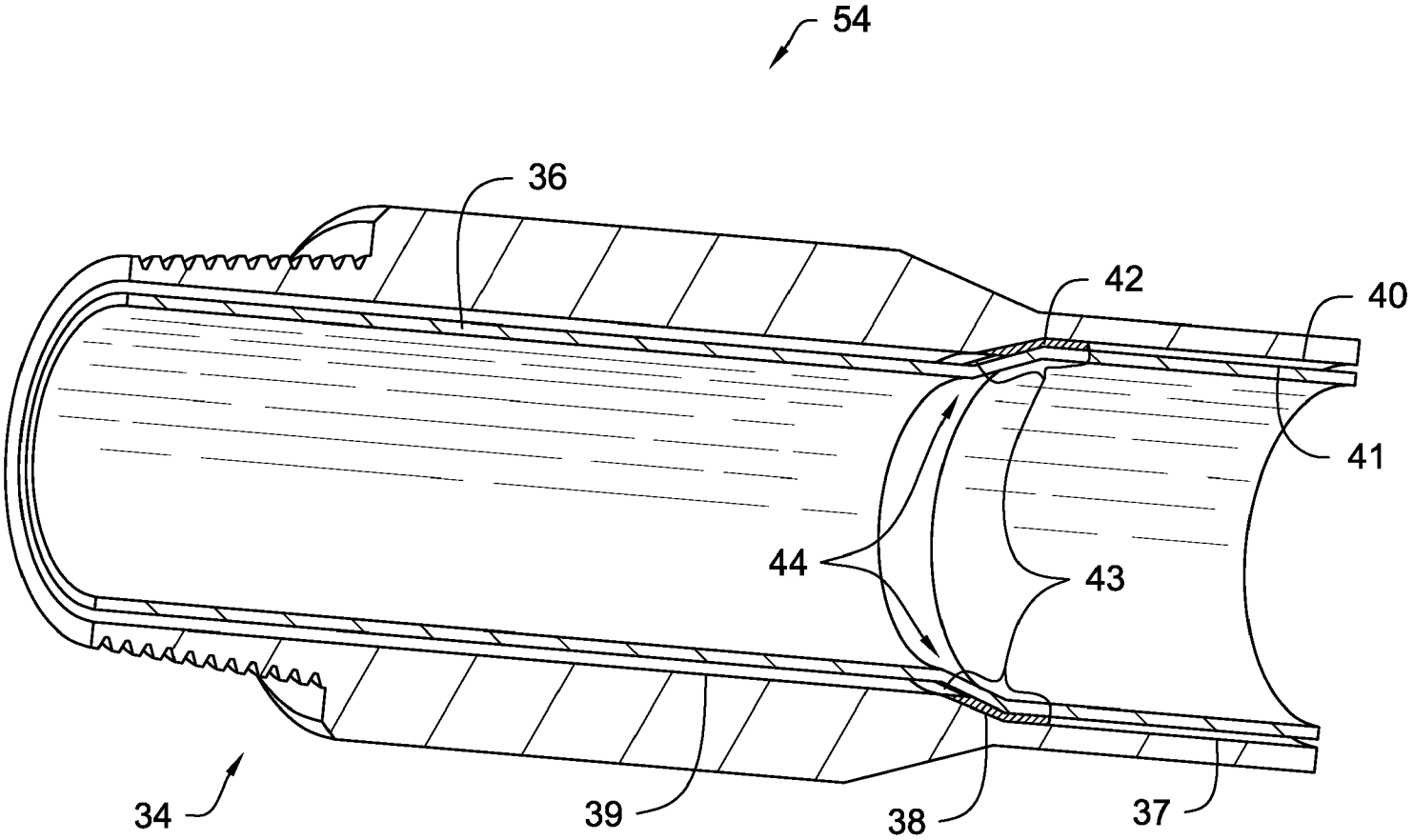
FIG. 3 is an enlarged cross sectional view of an end of the present invention.

FIG. 3 is an enlarged view of the pin end 54 of FIG. 2. Once again for clarity, the metal tube 36 is depicted not fully expanded against the inside surface 40 of the pipe 34. In actuality, at this stage of expansion, where the metal tube 36 is not fully expanded, it is expected that the remains of the protrusions would still be visible. The protrusions would not be fully ironed out until the metal tube 36 is fully pressed against the inside surface 40 of the drill pipe 34. An outside surface 41 may make contact with the inside surface 40 of the drill pipe 34 when the metal tube 36 is fully expanded. The outside surface 41 may be rough helping to maintain contact with the inside surface 40. The transition region 38 may form a concave region 43 with the second diameter 37 of the inside surface 40. The transition region 38 may also form a convex region 44 with the first diameter 39 of the inside surface 40 of the drill pipe 34. A resilient ring 42 may fill the concave region 43 and reduce the stress felt by the metal tube 36 when expanding, which may cause a portion of the metal tube 36 adjacent to the concave region 43 to tear. The resilient ring may be made of rubber or a resilient polymer.

Figure 4:
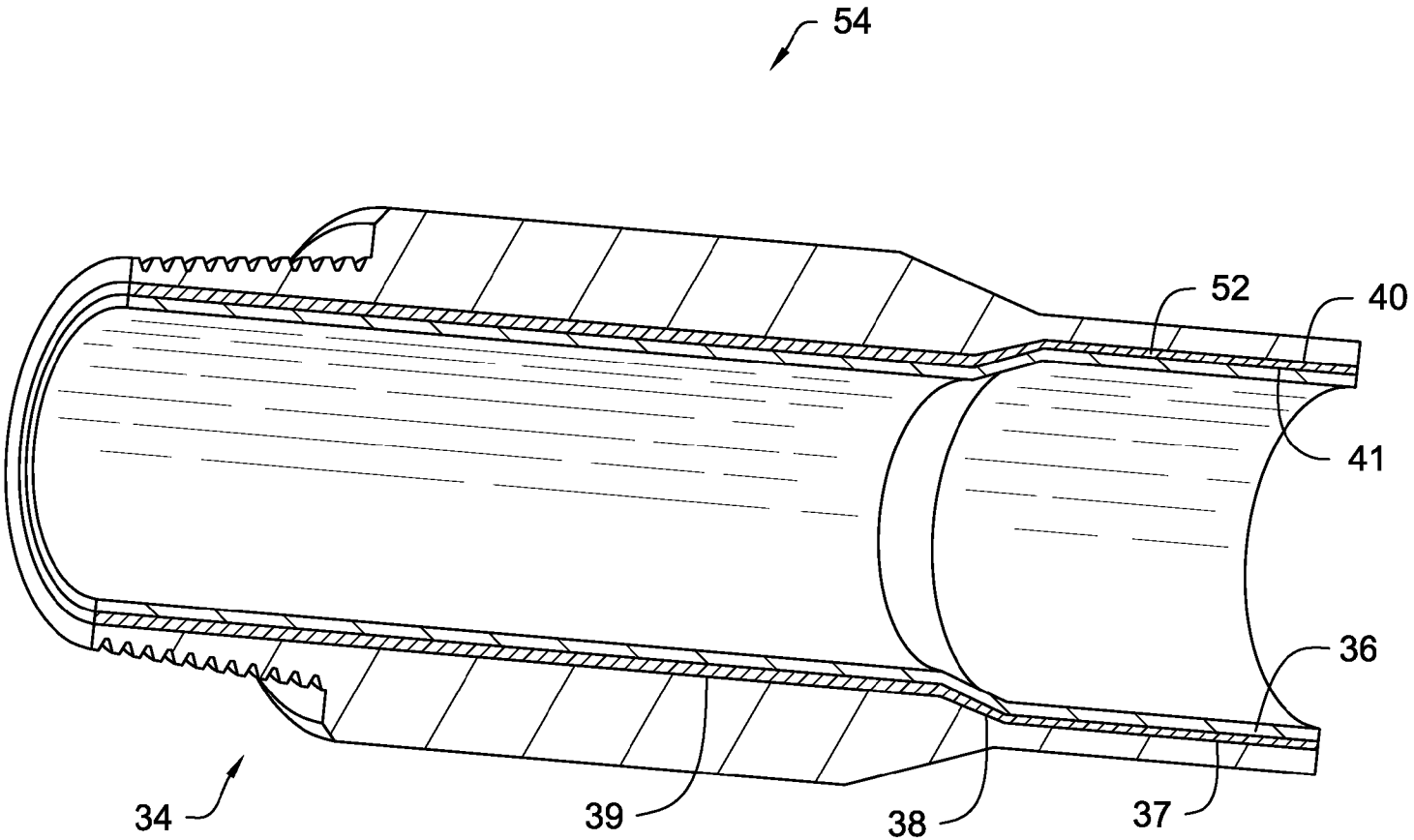
FIG. 4 is an enlarged cross sectional view of an end of the present invention.

It will be noted that where differing materials are used for the drill pipe 34 and the metal tube 36; for example a pipe that consists of 4100 series steel and a metal tube that consists of stainless steel; the intimate contact of the differing materials may induce a corrosive condition. In order to prevent galvanic corrosion, the metal tube 36 or the drill pipe 34, or both, may be coated with an electrically insulating material 52 that would form a barrier even when the metal tube 36 and the inside surface 40 of the pipe 34 come in contact with each other as shown in FIG. 4.

Figure 5:
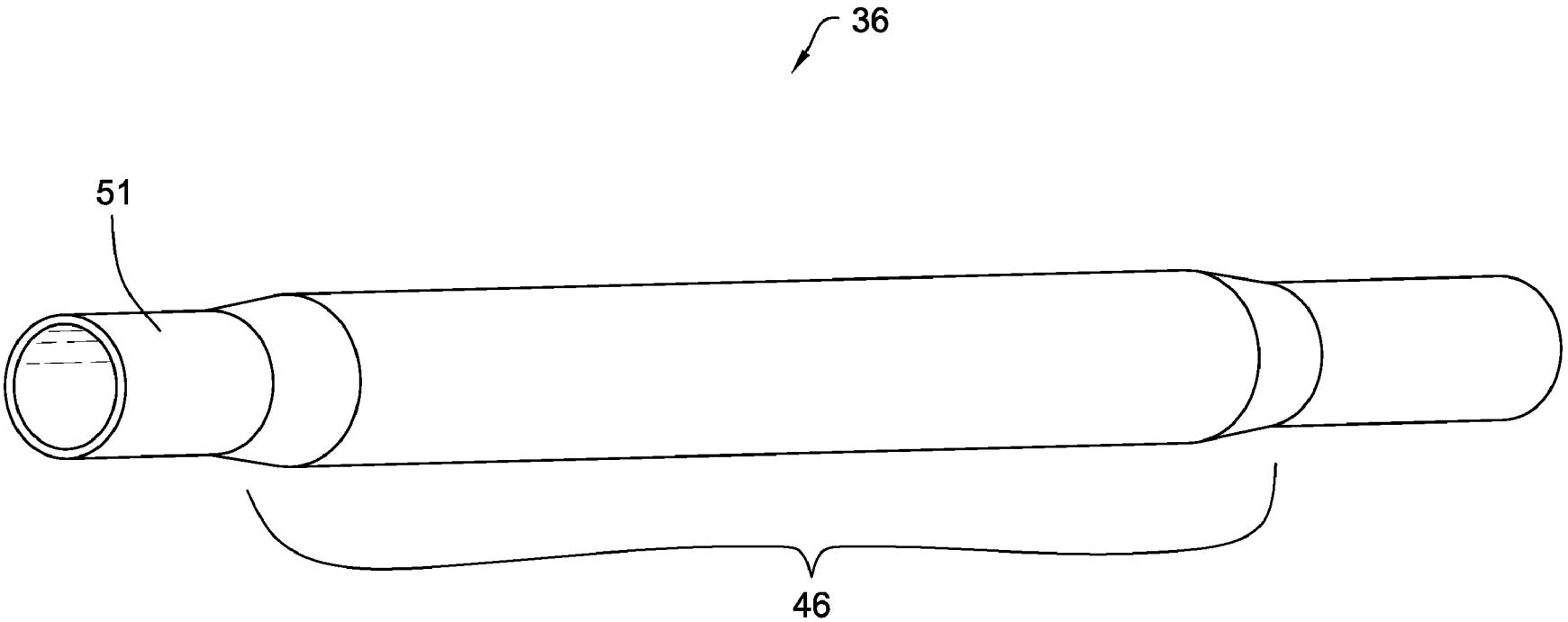
FIG. 5 is a perspective view of an expanded metal tube.

FIG. 5 is a view of the expanded metal tube 36 of the present invention. For clarity the tube is depicted outside the drill pipe 34. A non-uniform section 46 of the metal tube 36 has been expanded to accommodate the drill pipe 34 having a changing diameter in the transition region 38 and a smaller first diameter at end portions 51. For example, in order to provide a metal tube 36 for an upset, 5-⅞" double shouldered drill pipe obtainable from Grant Prideco, Houston, Tex., having a first diameter of approximately 4¼" and a second diameter of approximately 5", a 316 SS tube of approximately 33' in length and having a wall thickness of about 0.080" was obtained. The stainless steel tube was drawn through a series of carbide forming dies at Packless Metal Hose Company, Waco, Tex., in order to draw down the outside diameter of the tube to about 4.120". At the same time, the carbide dies formed the end portions 51 and the non-uniform section corrugations 47 (shown in FIGS. 6–11). A metal tube 36 similar to that shown in FIG. 1 was then inserted into the drill pipe, and the assembly was placed inside a suitable press constructed by the applicants. The end 51 of the metal tube 36 were sealed using hydraulic rams that were also capable of flowing pressurized water into the metal tube 36. Once the metal tube 36 was completely filled with water, the pressure of the water was increased in order to expand the metal tube 36 to match the second diameter 37 of the drill pipe 34. At around 150 PSI the protrusions 47 began to move or expand as was evidenced by expansion noises coming from inside the drill pipe 34. The pressure was increased to between 3500 and 5000 PSI whereupon the expansion noises nearly ceased. The applicants concluded that at about this time the metal tube 36 was fully expanded against the inside surface 40 of the drill pipe 34. Pressure inside the metal tube 36 was then increased to above 10,000 PSI where it is thought that the metal tube 36 was placed in compression against the inside surface 40 of the drill pipe 34. When the drill pipe 34 was removed from the press, visual inspection revealed that the metal tube 36 had taken on the general shape as depicted in FIG. 5, and that the metal tube 36 had been fully expanded against the inside surface 40 of the drill pipe 34. The applicant attempted to vibrate and remove the metal tube 36 but found that it was fixed tightly inside the drill pipe 34.

Figure 6:
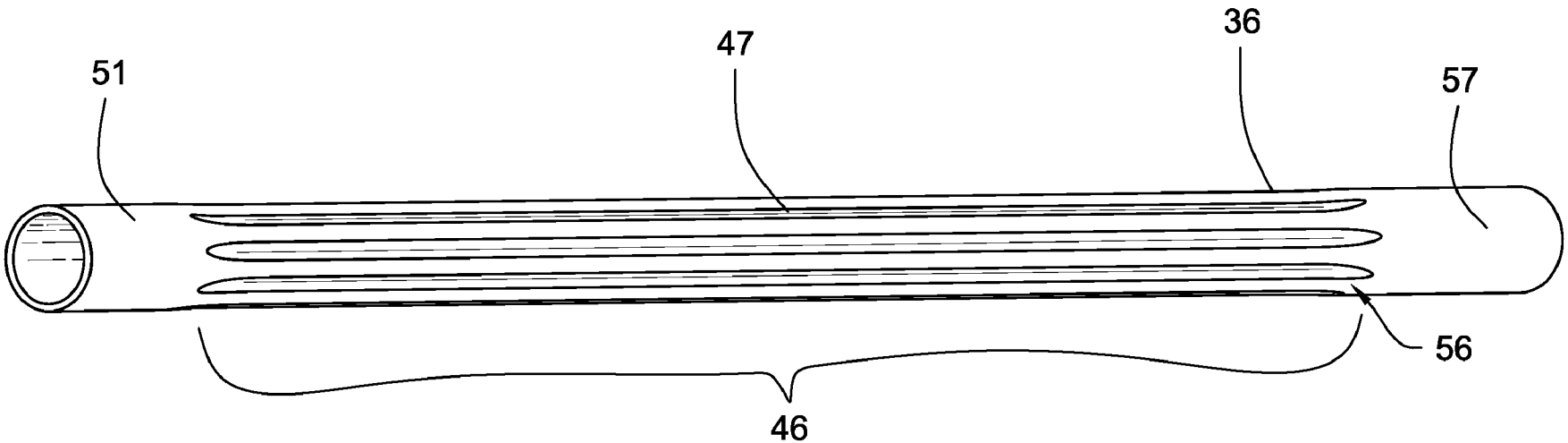
FIG. 6 is a perspective view of the metal tube comprising a corrugated non-uniformed section.

FIG. 6 is an illustration of a metal tube 36 of the present invention. The metal tube 36 comprises regular end portions 51 and a non-uniform section 46 consisting of intermediate protruded corrugations. In this figure, the protrusions 47 are longitudinally axial along the length of the metal tube 36. At the ends of each protrusion 47 are transition regions 56 that may generally correspond to the transitional regions 38 within the upset drill pipe 34. The wall thickness of region 56 may range from between about one half the wall thickness to greater than the thickness of the tube wall. Suitable metal materials for the metal tube 36 may be selected from the group consisting of steel, stainless steel, aluminum, copper, titanium, nickel, molybdenum, and chrome, or compounds or alloys thereof. The metal tube 36 is formed by providing a selected length of tubing having an outside diameter at least as great as the desired finished diameter of the metal tube 36, and by drawing the metal tube 36 through one or more dies in order to decrease the outside diameter of the metal tube 36 and form the end portions 51 and corrugations. Alternatively, the convolutions are formable by metal stamping, hydroforming, or progressive roll forming. In the process of forming the end portions 51 and corrugations, the outside diameter of the metal tube 36 is decreased so that it may be inserted into a drill pipe 34, where the first diameter 39 of the drill pipe 34 is smaller than the outside diameter 57 of the metal tube 36. Once the metal tube 36 is inside the drill pipe 34, the metal tube 36 is plugged and hydraulically or mechanically expanded to its desired diameter. The protrusions 47 in the tube 36 allow the metal tube 36 to expand to at least its original outside diameter 57 and beyond, if so desired, without over straining the material of the metal tube 36. In this fashion the metal tube 36 may accommodate the changing inside surface 40 of the drill pipe 34. Another method of expanding the tube 36 is depicted in U.S. Pat. No. 2,263,714, incorporated herein by this reference, which discloses a method of drawing a mandrel through a metal tube 36 in order to expand it against the inside surface 40 of a drill pipe 34. Although the reference does not anticipate a first and a second diameter 37, 39, the mandrel may be adapted, according to the present invention, to size the tube 36 to the desired configuration within the drill pipe 34.

Figure 7:
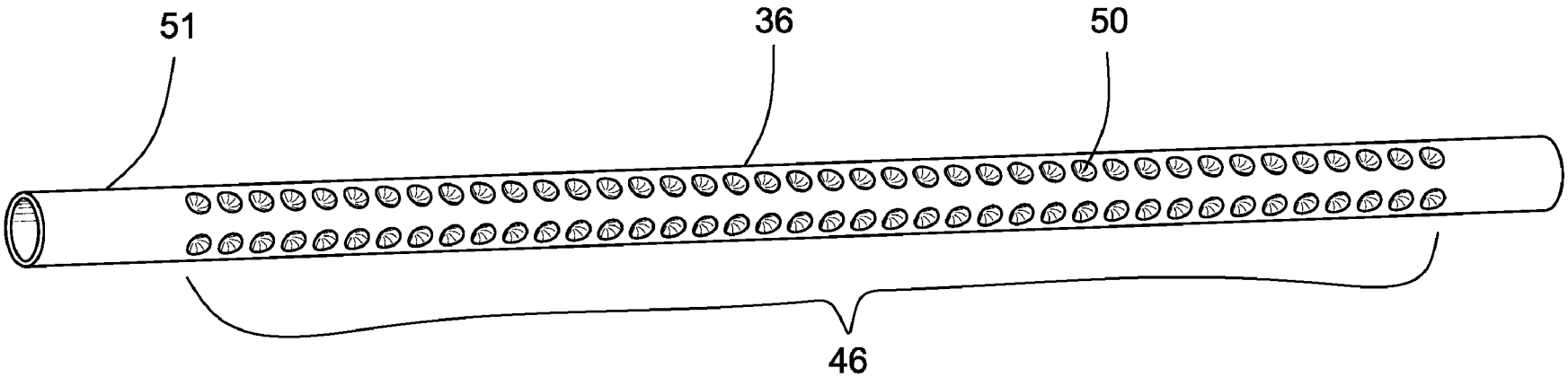
FIG. 7 is a perspective view of a metal tube having a dimpled non-uniform section.
Figure 8:
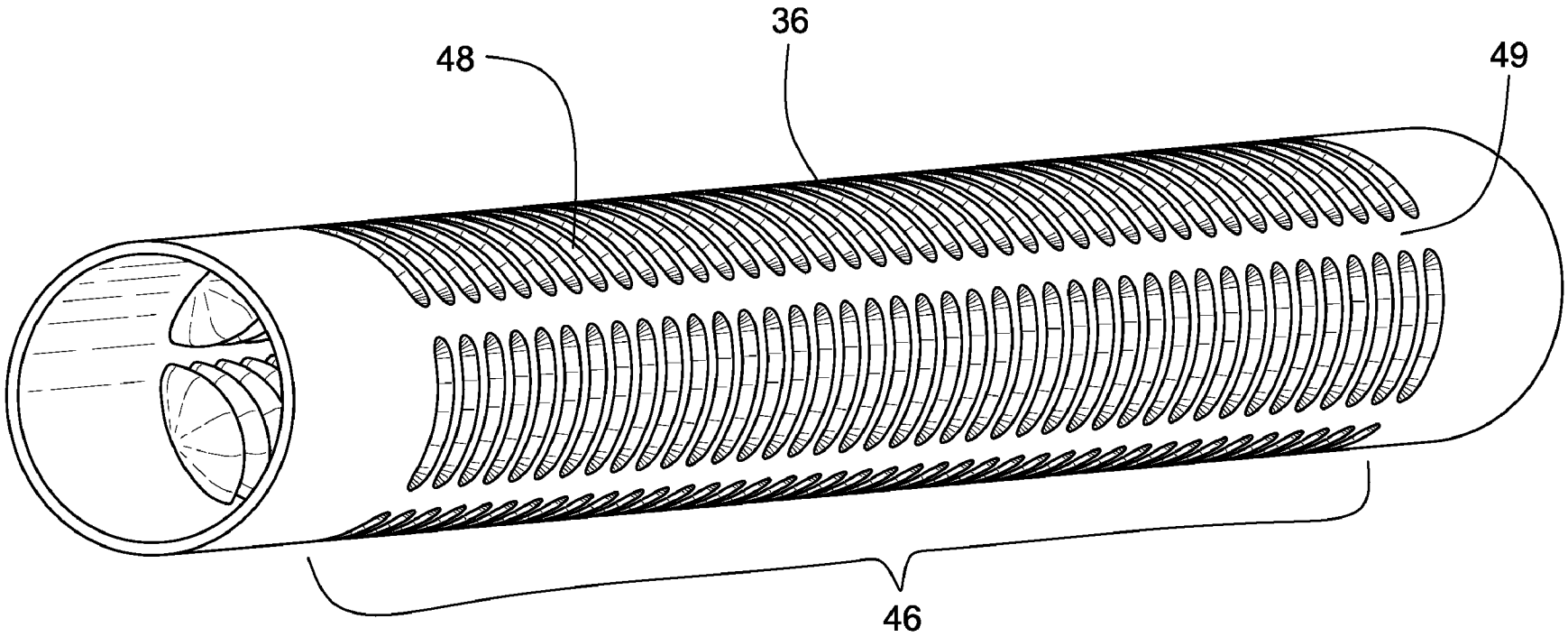
FIG. 8 is a perspective view of a metal tube having an ovoid non-uniform section.

FIG. 7 illustrates a metal tube 36 having end portions 51 and a non-uniform section 46 of dimpled protrusions 50 along the length of the metal tube 36. The dimples 50 may be positive or negative with respect to the surface of the tube 36. As depicted the dimples 50 are generally round in shape, but they may be ovoid or elongated as shown in FIG. 8, and the properties of FIG. 7 are applicable to the properties of FIG. 8, and vice versa, where the non-uniform section 46 of the tube 36 has ovoid protrusions 48. Although, the dimple pattern as shown is regular in both FIGS. 7 and 8 along the longitudinal axis of the metal tube 36, alternative patterns are possible and may be beneficial. For example, the pattern may be spiral or the pattern may consist of a combination of protrusion styles alternating within the border region.

Figure 9:
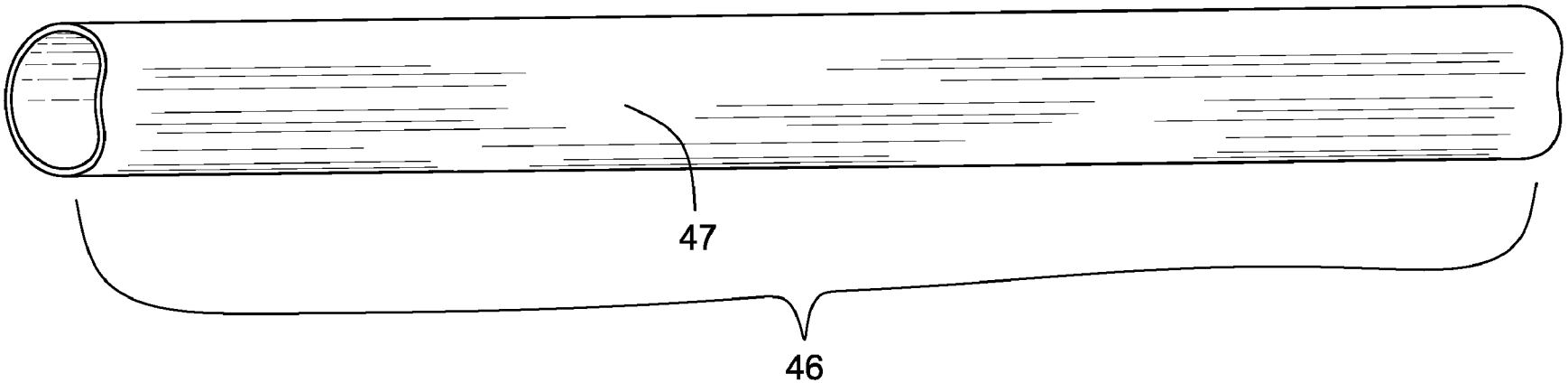
FIG. 9 is a perspective view of a metal tube having a concave non-uniform section.

FIG. 9 is a view of another non-uniform section 46 of the present invention provided in a tube 36. The protrusion 47 consists of a single corrugation along the full lengthwise axis of the tube 36. Multiple corrugations are possible, but a single corrugation may be adequate. This design may also be used in connection with the regular end portions 51. This modified "D" configuration is appealing for its simplicity in design, and yet it is capable of accommodating a drill pipe having a regular inside diameter. Tests by the applicants have shown that both thick and thin walled tubing, say between 0.010" and 0.120" benefit from the non-uniform section 46 of the present invention during expansion. Without the non-uniform section 46, FEA analysis has shown that the tube 36 will likely rupture before it is sufficiently expanded against the inside surface 40. The configuration depicted in FIG. 9 may be useful in situations where it is desired to place a conduit or conductor cable along the inside of the drill pipe 34. The protrusion 47 may provide a pathway for the conduit and would form itself around the conduit during expansion. Then, not only would the metal tube 36 benefit the performance of the drill pipe 34, but it would also serve to fix the conduit or cable in place and protect it from the harsh down hole environment.

Figure 10:
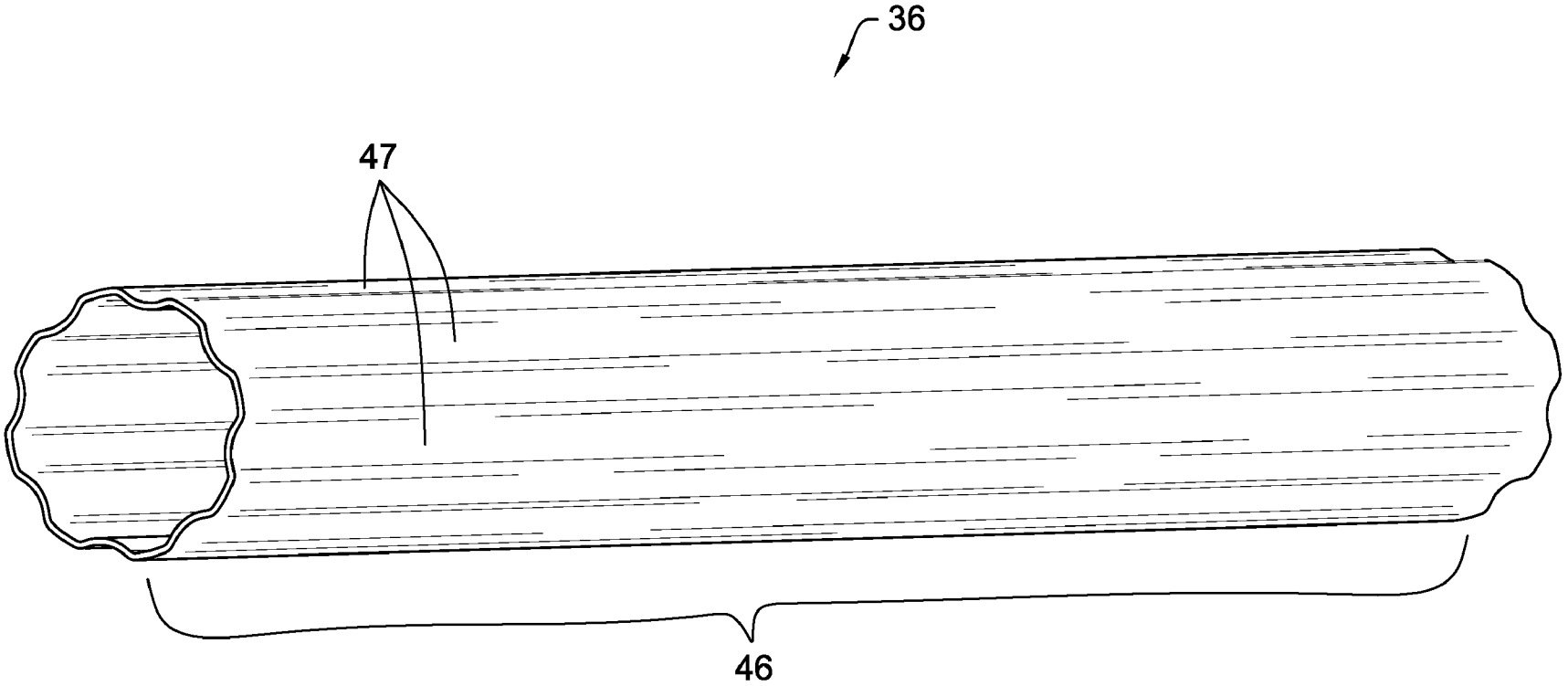
FIG. 10 is a perspective view of a metal tube having a corrugated non-uniform section.

FIG. 10 is a view of a non-uniform section 46 provided in a metal tube 36. The non-uniform section 46 consists of longitudinal corrugations that may or may not extend the full length of the metal tube 36. As depicted, the protrusion 47 are at regular intervals around the circumference of the metal tube 36, however, the applicants believe that an irregular pattern may be desirable depending on the configuration of the inside surface 40 against which the conformable tube 36 will be expanded. The desired depth of the protrusions as measured perpendicularly from the crest of the outer-most surface to the inside diameter as represented by the inner most surface of the trough may be determined by the total expansion required of the metal tube 36. For example, if the metal tube 36 were to be installed into a drill pipe 34 having a uniform inside diameter, the protrusions 47 would not have to be as deep as the protrusions 47 may need to be if the metal tube 36 were to be installed into a drill pipe 34 having an inside surface 40 with a varying diameter. For example, for a drill pipe 34 having a uniform inside diameter, the depth of the protrusions may be approximately equivalent to one half of the wall thickness of the metal tube 36 and be adequate to achieve sufficient expansion inside the drill pipe 34, depending on the number of protrusions and their proximity to each other. On the other hand, where the inside wall of the drill pipe 34 has a varying diameter, the protrusions may have to exceed the greatest variation between inside diameter irregularities. These are critical dimensions that are included within the teachings of the metal tube 36 of the present invention.

Figure 11:
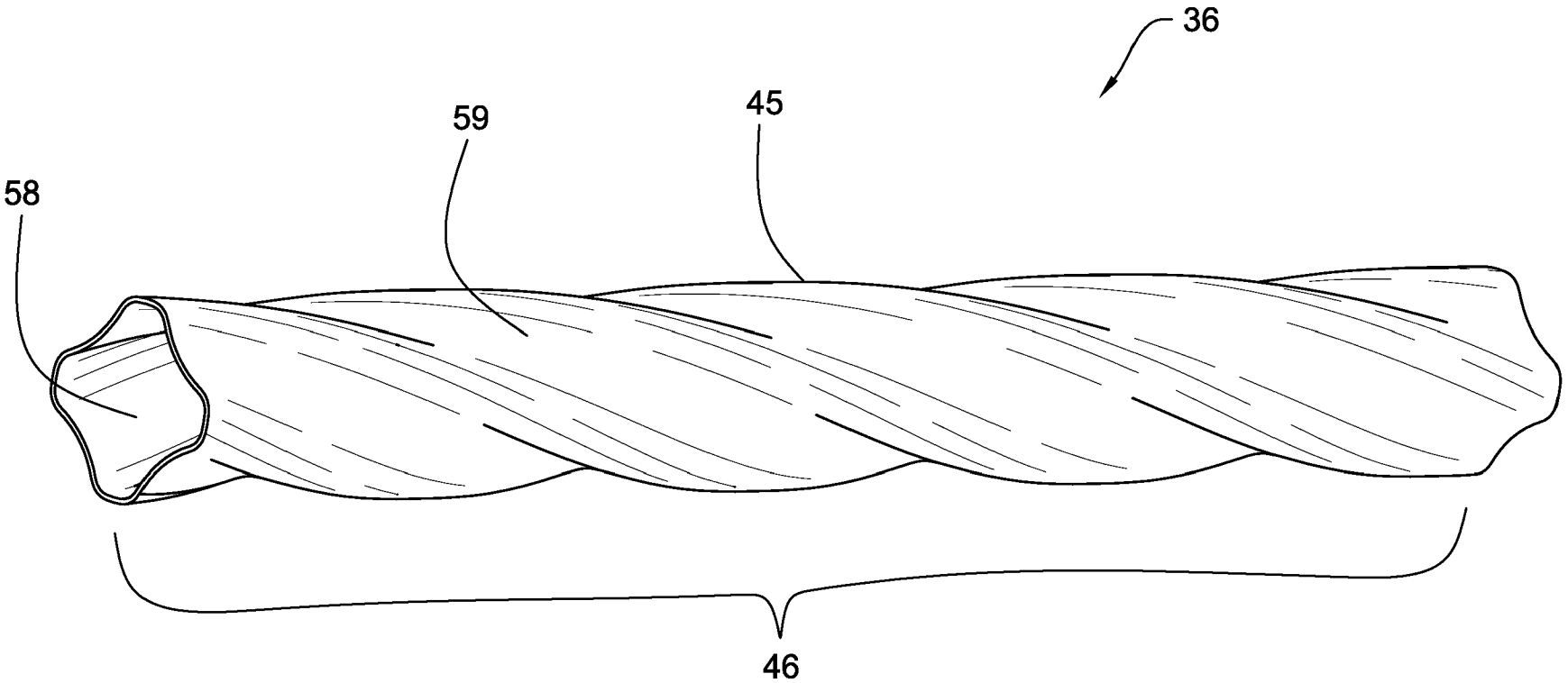
FIG. 11 is a perspective view of a metal tube having a spirally fluted non-uniform section.

FIG. 11 is a view of the metal tube 36 of FIG. 10 modified so that the metal tube 36 exhibits a non-uniform section 46 along its length consisting of an inner wall 58 and an outer wall 59 made up of protrusions 47 that are formed into spiral flutes 45. This configuration would be useful in drill pipes 34 having uniform inside wall surfaces. The flutes 45 may be proportioned so that conduits and conductors may be disposed within the troughs and run along the full length of the drill pipe 34. Such conduits and conductors would then be protected from the harsh fluids and tools that are circulated through the pipe's bore 53. In cases where it would be desirable to control the flow of fluid through the bore 53 of the drill pipe 34, it may be desirable to expand the metal tube 36 in such a manner so that the form of the protrusions 47 remain in the inside wall 58 of the metal tube 36 after it has been fully expanded. The modified flow produced by the presence of protrusions 47 in the inner wall 58 of the drill pipe 34 would be beneficial in reducing boundary conditions that tend to reduce the efficient flow of fluid through the drill pipe 34.

The invention claimed is:

1. An apparatus in a drill string, comprising: an internally upset drill pipe comprising a pin end, a box end, and an elongate tube intermediate the pin and box ends, the elongate tube and the ends comprising a continuous inside surface with a transition region a comprising a locking surface in both the pin end and the box end; a conformable metal tube disposed in a position within the drill pipe intermediate the ends thereof terminating adjacent to ends of the drill pipe; wherein the conformable metal tube substantially conforms to the continuous inside surface.

2. The apparatus of claim 1 wherein the metal tube is more corrosion resistant than drill pipe.

3. The apparatus of claim 1 wherein the metal tube has a rough outside surface.

4. The apparatus of claim 1 wherein the metal tube is expanded to conform to the drill pipe using hydraulic pressure.

5. The apparatus of claim 1 wherein the metal tube is expanded inside the drill pipe by being drawn over a mandrel.

6. The apparatus of claim 1 wherein the apparatus comprises an insulating material between the metal tube and the inside surface.

7. The apparatus of claim 6 wherein the insulating material resists galvanic corrosion between the metal tube and the inside surface.

8. The apparatus of claim 1 wherein the metal tube is adapted to stretch with the drill pipe.

9. The apparatus of claim 1 wherein the metal of the metal tube is selected from the group consisting of steel, stainless steel, titanium, aluminum, copper, nickel, chrome, and molybdenum, or compounds, mixtures, and alloys thereof.

10. The apparatus of claim 1 wherein the metal tube comprises a non-uniform section expanded to conform to the inside surface of the drill pipe.

11. The apparatus of claim 10 wherein the metal tube has a regular end portion that is free of the non-uniform section.

12. The apparatus of claim 10 wherein the non-uniform section comprises protrusions selected from the group consisting of convolutions, corrugations, flutes, and dimples.

13. The apparatus of claim 10 wherein the non-uniform section extends generally longitudinally along the length of the elongate tube.

14. The apparatus of claim 10 wherein the non-uniform section extends spirally along the surface of the tube.

15. The apparatus of claim 10 wherein the non-uniform section is intermediate regular end portions of the metal tube.

16. The apparatus of claim 10 wherein the non-uniform section is formed using hydraulic pressure.

17. The apparatus of claim 10 wherein the non-uniform section is formed by roll forming or by stamping.

18. The apparatus of claim 1 wherein one or more dies are used to form the non-uniform section of the tube.

19. The apparatus of claim 1 wherein inside surface comprises a transition region forming a convex region and a concave region in the inside surface.

20. The apparatus of claim 19 wherein the concave region comprises a resilient ring.

* * * * *